US008025016B2

(12) United States Patent
Adams

(10) Patent No.: US 8,025,016 B2
(45) Date of Patent: Sep. 27, 2011

(54) LAPTOP COMPUTER DESK

(76) Inventor: Paul Adams, Albuquerque, NM (US)

( * ) Notice: Subject to any disclaimer, the term of this patent is extended or adjusted under 35 U.S.C. 154(b) by 825 days.

(21) Appl. No.: 11/463,651

(22) Filed: Aug. 10, 2006

(65) Prior Publication Data

US 2008/0035029 A1 Feb. 14, 2008

(51) Int. Cl.
*A47B 13/02* (2006.01)

(52) U.S. Cl. ..... 108/150; 108/6; 108/50.01; 108/43

(58) Field of Classification Search ..... 108/43, 108/49, 5, 105, 137, 10, 25, 50.01, 150, 6; 297/172, 170; 248/454, 157, 419
See application file for complete search history.

(56) References Cited

U.S. PATENT DOCUMENTS

| | | | | | |
|---|---|---|---|---|---|
| 1,232,757 | A * | 7/1917 | Berkey | 108/49 |
| 1,280,874 | A * | 10/1918 | Scott | 297/172 |
| 1,841,770 | A * | 1/1932 | Tharp | 248/454 |
| 2,632,496 | A * | 3/1953 | Willis et al. | 108/6 |
| 5,161,766 | A * | 11/1992 | Arima | 248/447 |
| 5,606,917 | A * | 3/1997 | Cauffiel | 108/42 |
| 5,615,620 | A * | 4/1997 | Owen | 108/49 |
| 5,771,613 | A * | 6/1998 | Geils et al. | 108/176 |
| 5,893,607 | A * | 4/1999 | Trimnell | 108/49 |
| 6,270,157 | B1 * | 8/2001 | Kapushinski | 297/172 |
| 6,327,982 | B1 * | 12/2001 | Jackson | 108/5 |
| 6,776,104 | B2 * | 8/2004 | Herbst | 108/25 |
| 6,874,429 | B2 * | 4/2005 | Bosman et al. | 108/59 |
| 7,156,026 | B2 * | 1/2007 | McClellion | 108/43 |

* cited by examiner

*Primary Examiner* — José V Chen
(74) *Attorney, Agent, or Firm* — The Adams Law Firm

(57) ABSTRACT

A laptop computer desk.

20 Claims, 10 Drawing Sheets

10
40
62
60
66
64
20

60
20
40
62
64

62
64
68
60
20
22
24

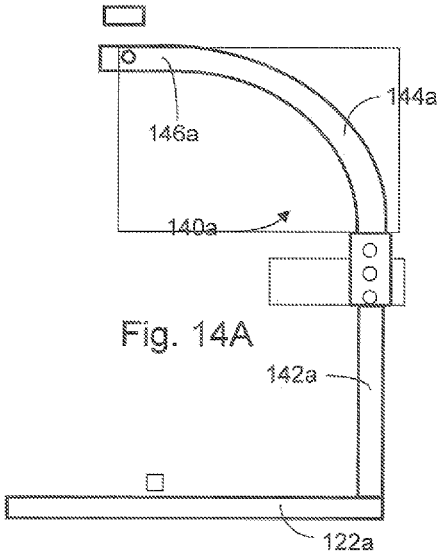
Fig. 14A
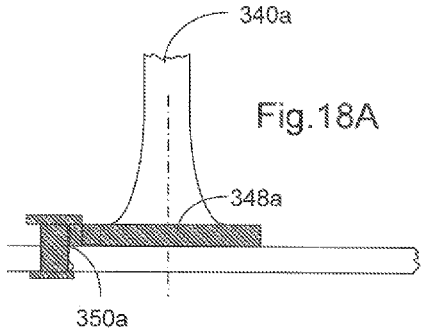
Fig.18A
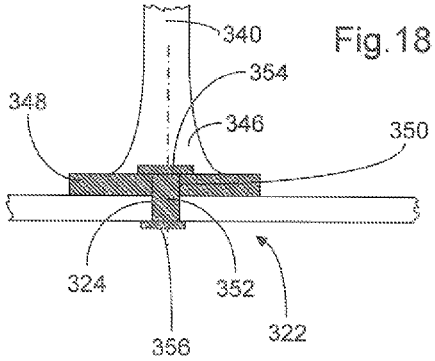
Fig.18
Fig.17
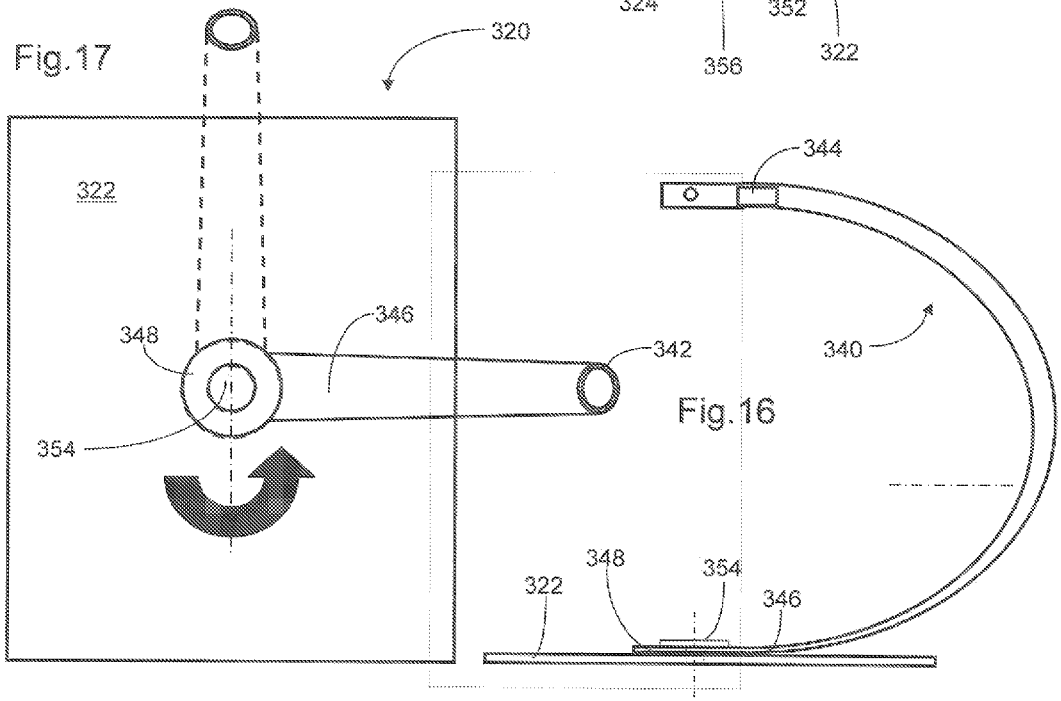
Fig.16

Fig. 20
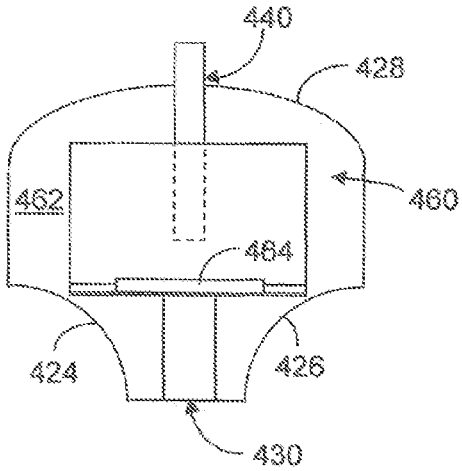
Fig. 21
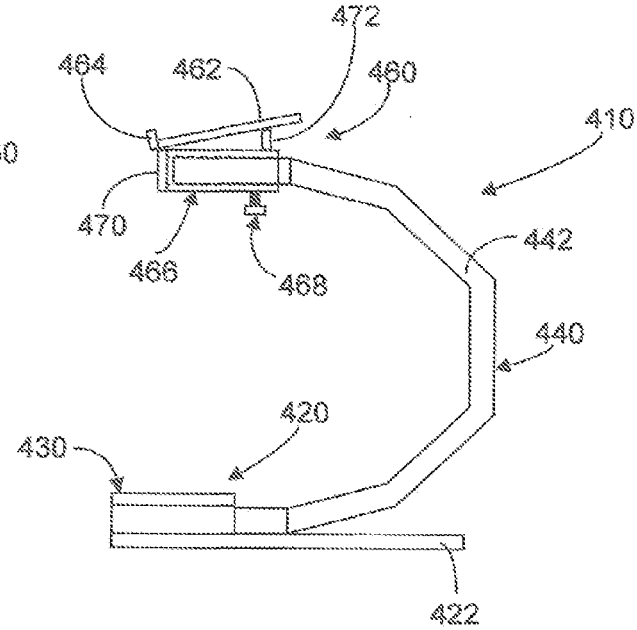
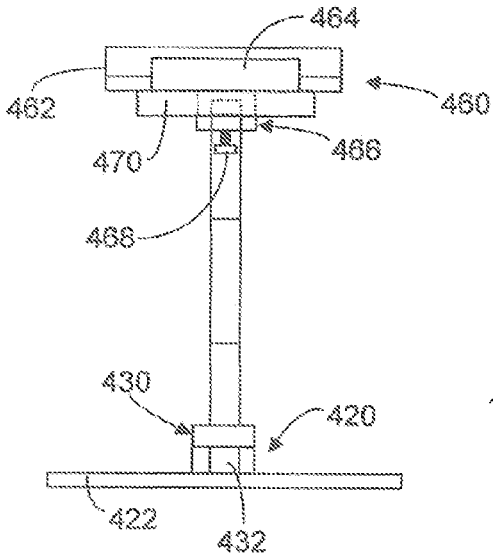
Fig. 19

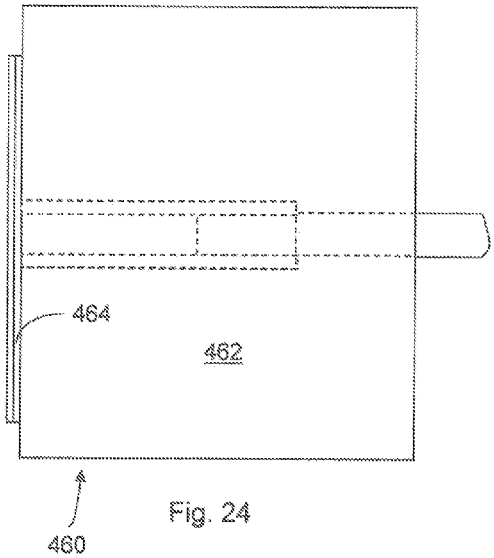
Fig. 24
Fig. 22B
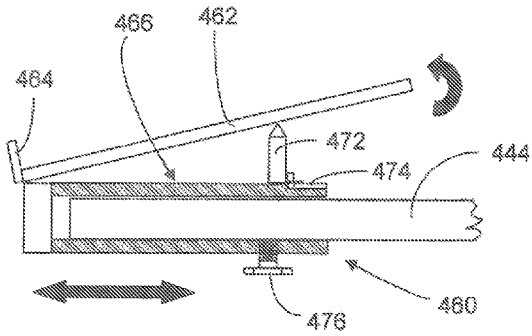
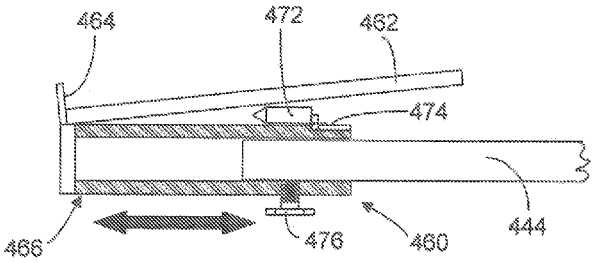
Fig. 22A
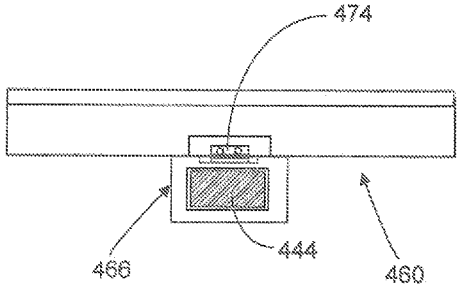
Fig. 23

Fig. 27
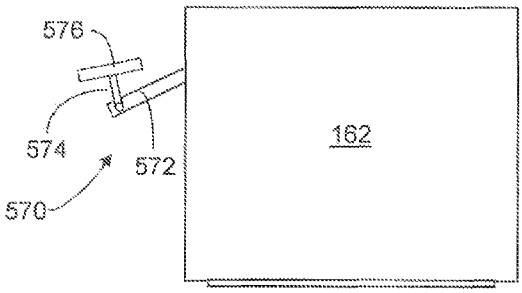
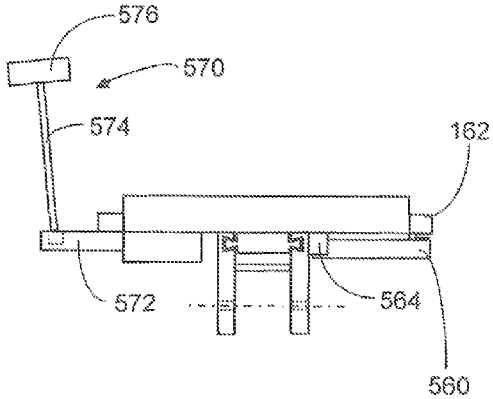
Fig. 29
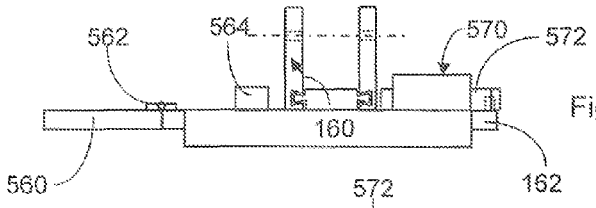
Fig. 26
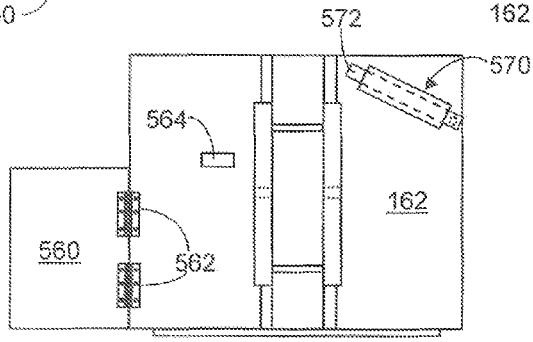
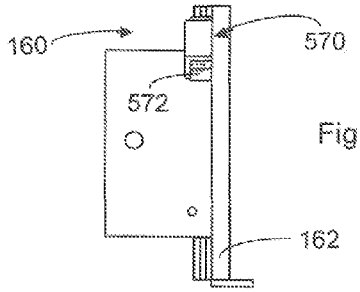
Fig. 28
Fig. 25

LAPTOP COMPUTER DESK

BACKGROUND OF THE INVENTION

1. Field of the Invention (Technical Field)

The present invention relates to an apparatus for supporting a laptop computer when in use.

2. Background

Many computer users prefer to use laptop computers in the office as well as when traveling. Due to the height of the normal office desk, it may not be comfortable to use a laptop computer that sits on the top of a desk because the keyboard is too high. Moreover, there may be several cables extending from the back of the laptop computer, for example, a power cable, a printer cable, and a mouse cable. These cables are in the way when the laptop computer is placed on the desk because the cables overlie portions of the desk interfering with placement and removal of other items on the desk. Furthermore, the under-desk trays that are typically used for the keyboard of a desktop computer, while vertically adjustable, are not convenient for placement of a laptop computer.

In a home environment or hotel it may be desirable to use a laptop computer while sitting in an easy chair. Despite its name, it is not comfortable to use a laptop computer sitting on the user's lap for any prolonged period of time due to the heat that is produced by the electronic components. There is typically no furniture in a hotel room or in one's home that would allow the laptop computer to be conveniently positioned for use while sitting in a chair.

The term "laptop computer" is intended to cover a broad class of computing devices that are small, portable, lightweight, and battery powered compared to what are commonly referred to as a desktop computer. Typically, a laptop computer includes a CPU, memory, monitor, and a keyboard. However, recognizing the usual rapid advances in computer technology, the term laptop computer is intended to include devices with input other than a keyboard and/or mouse such as a voice recognition module or other alphanumeric input device, or devices where the CPU may be a minor component because the internet provides the computing function or a device without permanent memory using on-line memory storage as an alternative. Moreover, some users of laptop computers use the computer as a video presentation device for DVD movies; it is expected that interactive video watching will involve some input mechanism for the user that may be a simple keypad and/or cursor controller rather than a keyboard. Thus, the device may comprise only a monitor and basic input capability. Moreover, size is a relative term and while future laptop computers may be small with respect to non-monitor components the screen may be as large as a current laptop screen to maintain a proper user interface. Current laptop sizes may be 10-14 inches measured rectangularly, but devices such as Viaio or even the Blackberry or Palm Pilot are considered within the scope of the term laptop computer for purposes of this patent application. Thus, the term "laptop computer" includes a wide variety of equipment presently exemplified by a laptop but likely to metamorphose into other devices with similar functionality but of different structural configuration. The emphasis on the type of equipment for which the present invention is intended for use is on size, weight and portability.

SUMMARY OF THE INVENTION

The present invention comprises a desk for a laptop computer.

BRIEF DESCRIPTION OF THE DRAWINGS

The accompanying drawings, which are incorporated into and form a part of this specification, illustrate one or more embodiments of the present invention and, together with the written description, serves to explain the principles of the invention. The drawings are only for the purpose of illustrating the many embodiments of the invention and are not to be construed as limiting the implementation of the invention.

FIG. 14A is another embodiment of a laptop computer desk in accordance with the present invention;

FIG. 16 is a side elevation view of another embodiment of the invention;

FIG. 17 is a top-plan view of a portion of the embodiment shown in FIG. 16 illustrated in two positions;

FIG. 18 is an enlarged view of the base of the embodiment shown in FIG. 16;

FIG. 18A is another embodiment of the base shown in FIG. 18;

FIG. 19 is a front elevation view of another embodiment of a laptop computer desk in accordance with the present invention;

FIG. 20 is a top-plan view of the embodiment shown in FIG. 19;

FIG. 21 is a side elevation view of the embodiment shown in FIG. 19;

FIG. 22A is an enlarged sectional view of the platform of the embodiment shown in FIGS. 19-21;

FIG. 22B shows the embodiment of FIG. 22A in a second position.

FIG. 23 is a rear elevation view of the embodiment shown in FIG. 22A;

FIG. 24 is a top elevation view of the embodiment shown in FIG. 22A

FIG. 25 is a bottom plan view of another embodiment of the platform assembly shown in FIGS. 8-11 in a first position;

FIG. 26 is a front elevation view of the embodiment shown in FIG. 25;

FIG. 27 is a top plan view of the embodiment of FIG. 25 shown in a second position;

FIG. 28 is a side elevation view of the embodiment of FIG. 25; and

FIG. 29 is a front elevation view of the embodiment shown in FIG. 27.

DETAILED DESCRIPTION OF EMBODIMENTS

Figure 1:
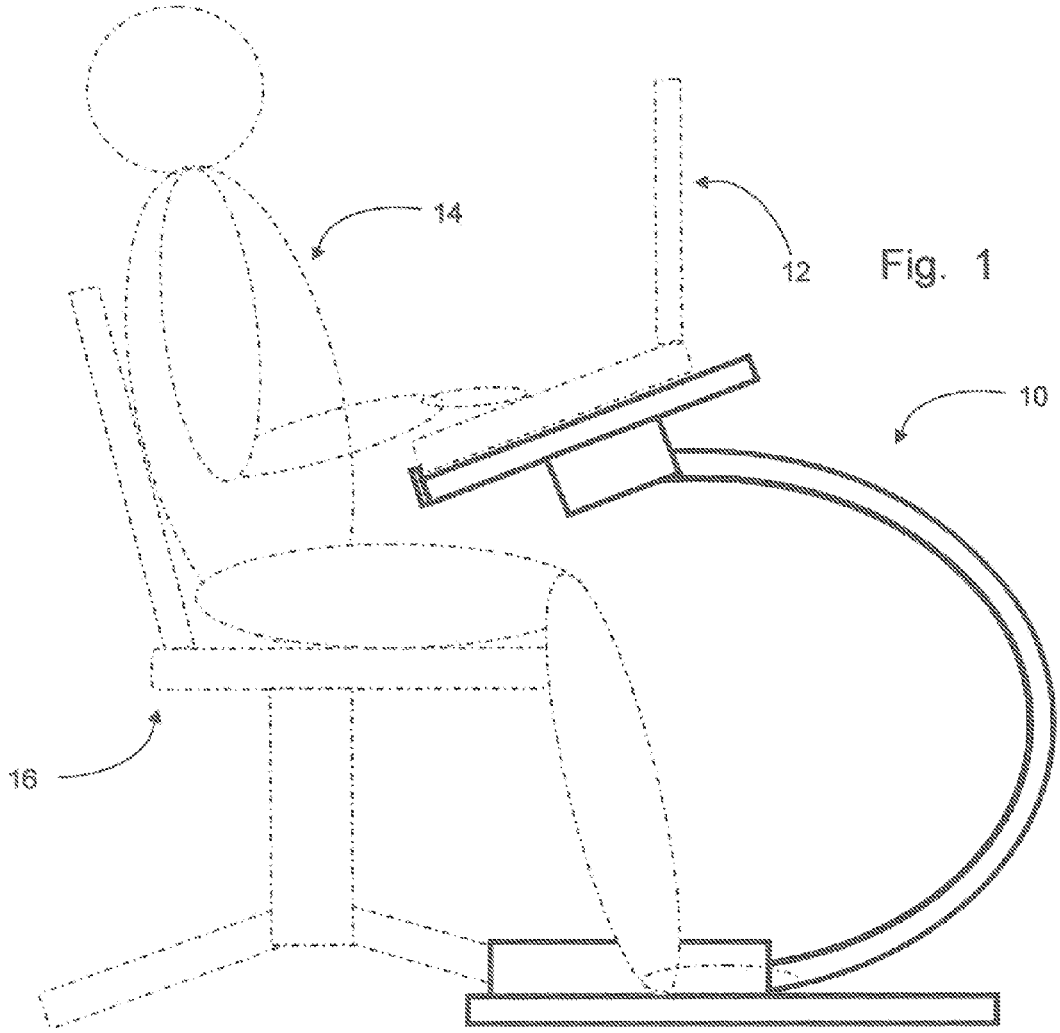
FIG. 1 is a side elevation view of the laptop computer desk of the present invention shown in use by a hypothetical user seated on a desk chair and with the laptop computer open.

A laptop computer desk, or apparatus or floor stand for supporting a laptop computer, indicated generally by reference numeral 10 of the present invention is shown in FIG. 1 together with a laptop computer 12 (shown in phantom lines), and a user 14 of the computer (also shown in phantom lines) sitting on a chair 16 (also shown in phantom lines). The word "desk" is used in this description of the invention to mean any generally horizontal surface raised above a floor on which work, such as reading, writing, or computer use may be performed. The word "apparatus" is used to mean equipment or an appliance designed for a specific purpose. A "floor stand" means an article of furniture having a base, upright and platform.

Figures 2, 3, 4:
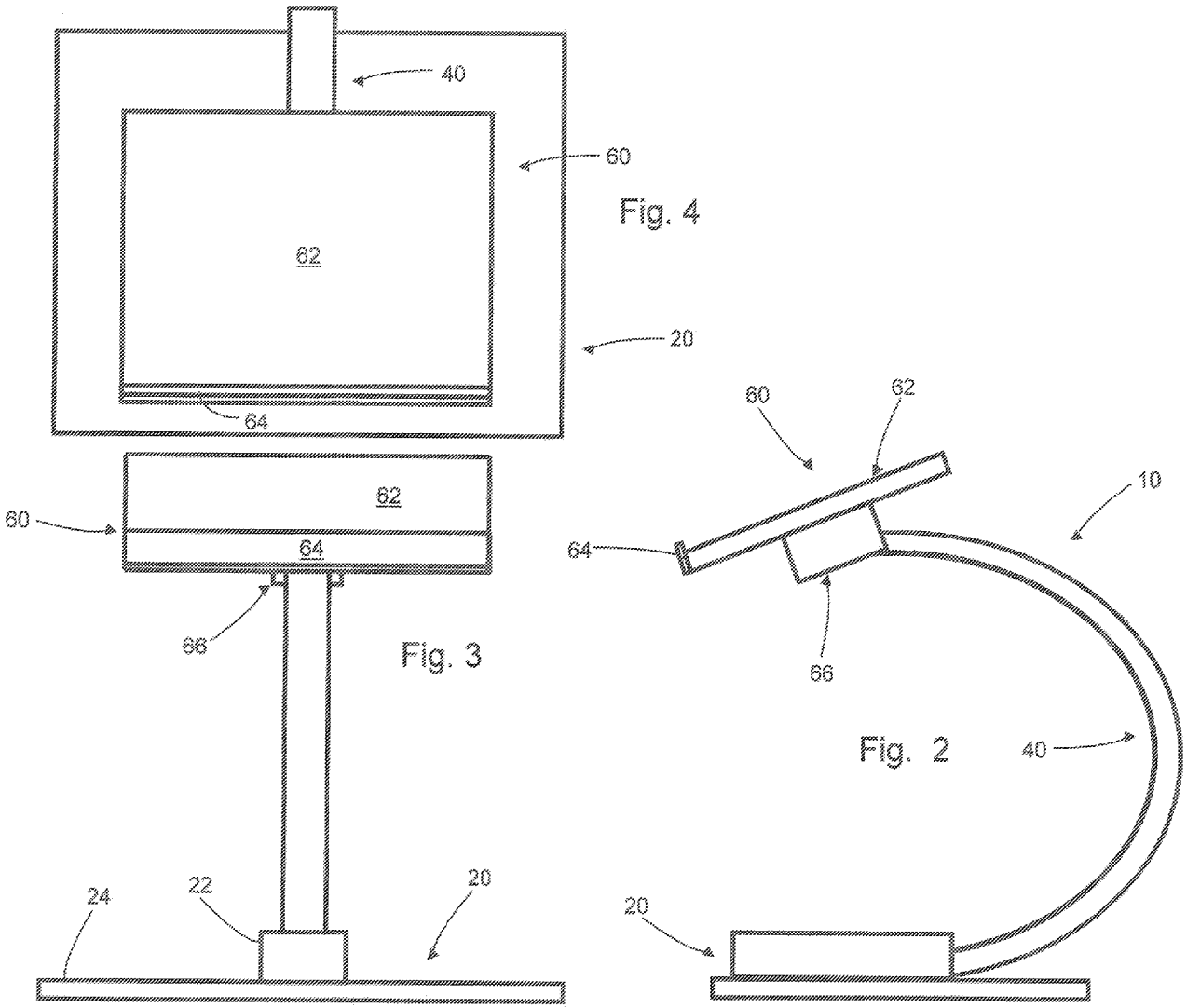
FIG. 2 is a side elevation view showing one embodiment of the present invention.
FIG. 3 is a front elevation view of the embodiment shown in FIG. 2.
FIG. 4 is a top-plan view of the embodiment shown in FIG. 2.

FIG. 2 is a side elevation view of the laptop computer desk 10 which includes: a base, pedestal or, horizontal floor member 20; a pylon, stanchion, column, pillar, pole, shaft, pilaster, upright or vertically rising member 40; and a platform or rest assembly 60, including a board, table, plate or generally flat, substantially rigid member 62 on which a laptop computer may rest. The base 20 may include a mounting unit 22 affixed to a board or plate 24. The unit 22 cooperates with the lower portion of the vertically rising member 40 so as to hold such member in fixed position relative to the base. The base 20 may be constructed of various materials including, but not limited to, wood, plastic, metal, composites or any combination thereof. The base 20 may have a flat planar surface or alternatively, the base 20 may be a truck comprising legs having wheels, rollers, or easily slidable feet at the ends of each leg, similar to the truck of a desk chair, for permitting the laptop supporting apparatus 10 to be easily moved. In the event that wheels or rollers are employed, it may be desirable to provide a mechanism to fix or lock the wheels or rollers when the desk is properly positioned for use. Those having ordinary skill in the art will appreciate that many types of bases may be suitable for providing a stable foundation in the present invention.

The vertically rising member 40 may also be constructed from a wide range of materials including wood, laminated wood, metal, plastic, composites or combinations thereof. The side profile of member 40 may have, in part, a semi-circular, semi-elliptical or parabolic shape, that is, a smooth curve. The curved member 40 is mounted on base 20 in a plane orthogonal to the user's body as shown in FIG. 1. Such orientation of the curved member 40 plant adds stability to the desk when the computer is in use compared to a plane parallel to the user's body.

The C-shape of the vertically rising member 40 functions to support the platform assembly 60 above the base 20 while creating an open space beneath the platform to allow the user to freely position and rearrange his or her legs without interference from the vertically rising member. The platform assembly 60 is effectively supported on the free end of a cantilever arm 44 to provide the desirable clearance beneath the platform. The cross-section of the stanchion 40 may be rectangular, circular, oval, or a polygonal shape that is aesthetically pleasing but has sufficient stability and rigidity to support the platform assembly 60. It may be desirable, or functionally necessary, to provide one or more braces from the base 20 to the member 40 to provide sufficient stability.

The platform assembly 60 includes a flat member or table 62 of sufficient size to steadily and properly support the weight of a laptop computer and the force applied by keyboarding. A typical size may be 10 inches by 12 or 14 inches. At the edge of the member 62 nearest the user, there may be a lip 64 to maintain the laptop computer in place when the table 62 is tilted as shown in FIG. 2. The lip may comprise a separate member or, for example, where the member 62 is metal or plastic, it may be integral with flat member 62. Attached to the bottom surface of table 62 is a housing 66 having an opening for receiving the free end of the cantilever arm portion 44 of pylon 40. Flat member 62 is preferably mounted at an angle from horizontal so as to provide convenient positioning of the keyboard of the laptop computer. It will be apparent to persons of ordinary skill in the art that the platform assembly 60 may be mounted on or carried by the portion 44 of vertically rising member 40 in a variety of ways, some of which are described below. Platform assembly 60 may be made of various materials including wood, metal, plastic, composites or combinations thereof.

As seen best in FIG. 1, the upright 40 and platform 60 are proportioned relative to the user in a seated position so that the keyboard is in approximately the plane of the user's forearms when typing. At the same time, the user's head is positioned vertically at the approximate level of the screen. The knees and lower legs of the person may be positioned in the free space below the platform and will not bump into the stanchion 40. It will also be seen that the user's feet may be conveniently placed on the base 20 which may aid in steadying the desk 10 when the apparatus rests on a carpeted floor.

Figure 7:
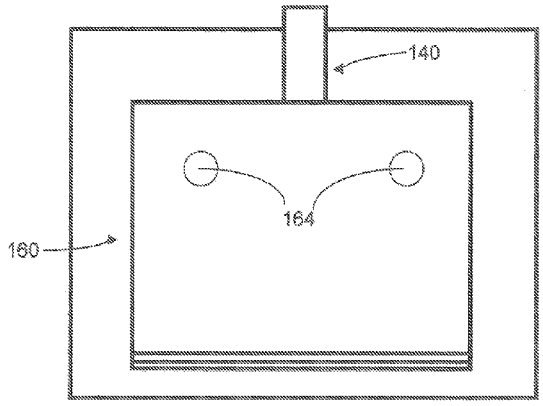
FIG. 7 is a top-plan view of the embodiment shown in FIG. 5.
Figure 6:
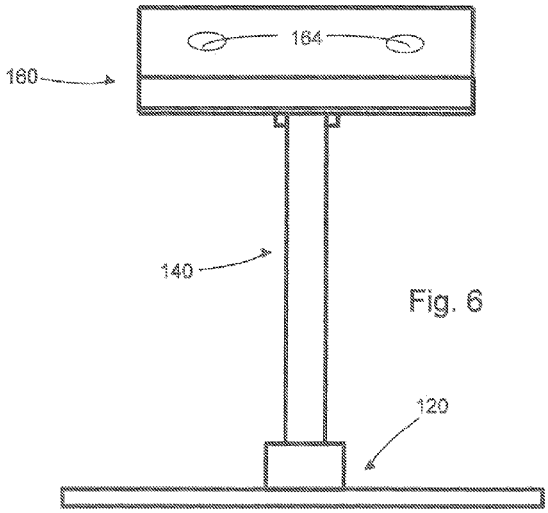
FIG. 6 is a front elevation view of the embodiment shown in FIG. 5.
Figure 5:
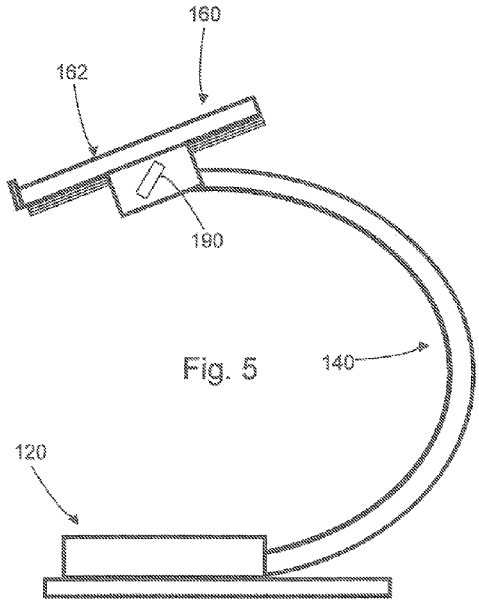
FIG. 5 is a side elevation view of another embodiment of a laptop computer desk of the present invention.
Figure 8:
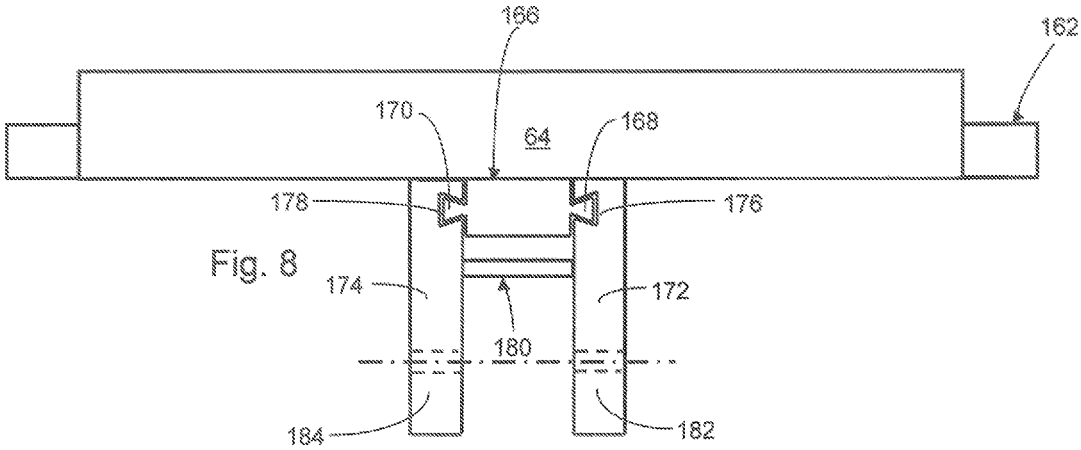
FIG. 8 is a front elevation view of the platform shown in FIGS. 5-7.
Figure 9:
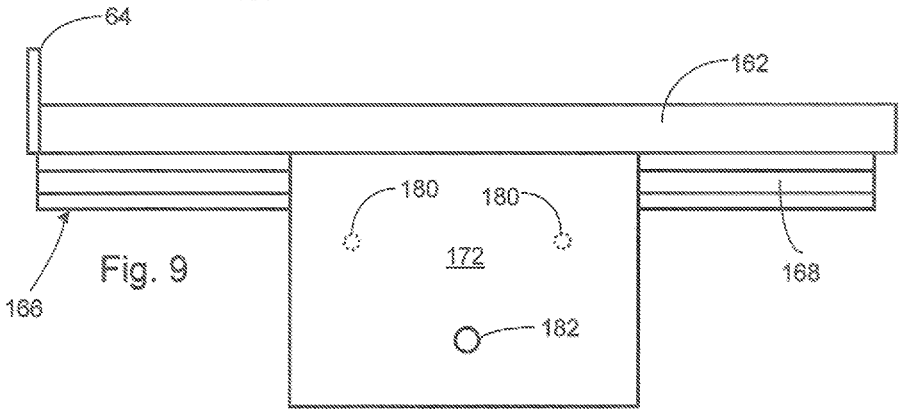
FIG. 9 is a side elevation view of the platform shown in FIG. 8.

Turning now to a second embodiment shown in FIGS. 5-7 the platform assembly 160 is adjustable as will be explained in reference to FIGS. 10 and 11. As seen in FIGS. 6 and 7, the upper surface of the board 162 includes rubber pads 164 that are adhered to the upper surface or are embedded so as to project slightly above the upper surface. The purpose of rubber pads 164 is to prevent the laptop computer from being inadvertently moved while keyboarding or while in use. The number of the rubber devices is matter of selection; various materials may be selected for such means for maintaining the laptop computer in a selected location. Alternatively, it may be desirable to coat or laminate the entire upper surface of the board 162 with a material such as rubber. Rubber is only exemplary of materials with a high frictional surface and of course various other means could be used such as a roughened surface of any material, or various plastic materials that provide a high-friction surface. Since some laptop computer bases are made of metal, it may be desirable to use magnets that are embedded in the upper surface of the board 162 to maintain the base of the laptop computer at a desired location. Other alternatives for the means for preventing inadvertent movement of the computer includes lips on the sides and/or back of the board 162, clamps, bungee straps, clips, or other means that will be apparent to persons having ordinary skill in the art.

FIGS. 8-11 show the platform assembly 160 in greater detail. It will be seen from the following description, that the plate 162 may be horizontally adjustable toward and away from the user, i.e., translationally. Moreover, the platform assembly 160 is simultaneously pivotal along a horizontal axis parallel to the plate 162 edge nearest the user. One embodiment of platform assembly 160 for providing both translational and pivotal or rotational movement of the plate 162 may comprise a first member 166 fixedly attached to the bottom surface of plate 162 and having sliding dovetail members 168 and 170. A dovetail housing comprises a pair of side members 172, 174 are slidably attached to the member 166 by having matching dovetail slots shown at 176, 178. As will be appreciated by those persons of ordinary skill in the art, sliding dovetails are only exemplary of mechanical arrangements that permit plate 162 to be slidably movable relative to the housing and the vertically rising member 140. A pair of pins 180 are mounted interiorly of the side members 172, 174 so as to hold them in alignment such that they will move in unison relative to the dovetail member 166. Toward the lower end of members 172, 174 there are a pair of aligned holes or openings 182, 184.

Figure 10:
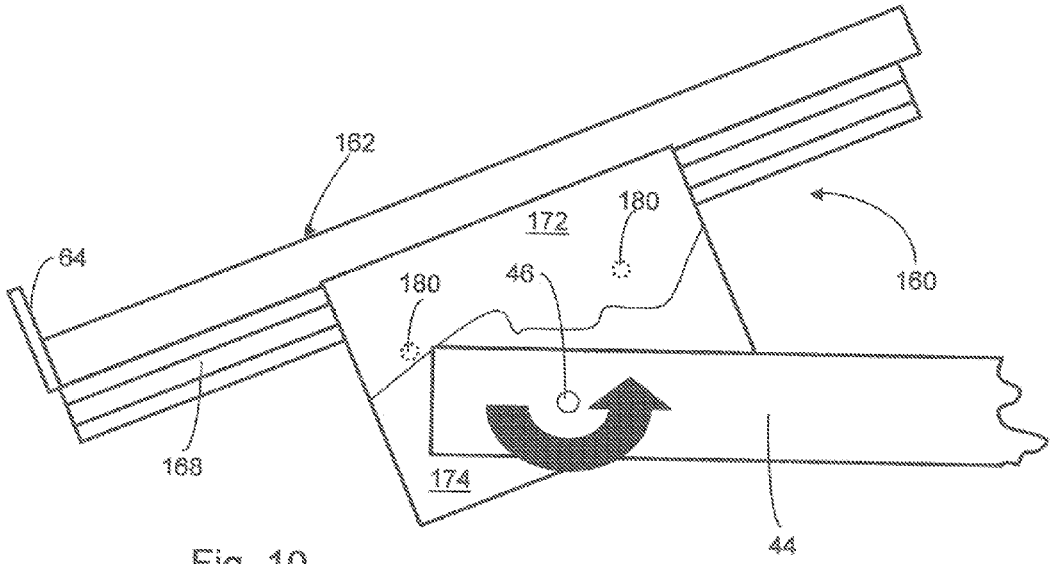
FIG. 10 is a side elevation view as in FIG. 9 showing the platform tilted relative to the floor.
Figure 11:
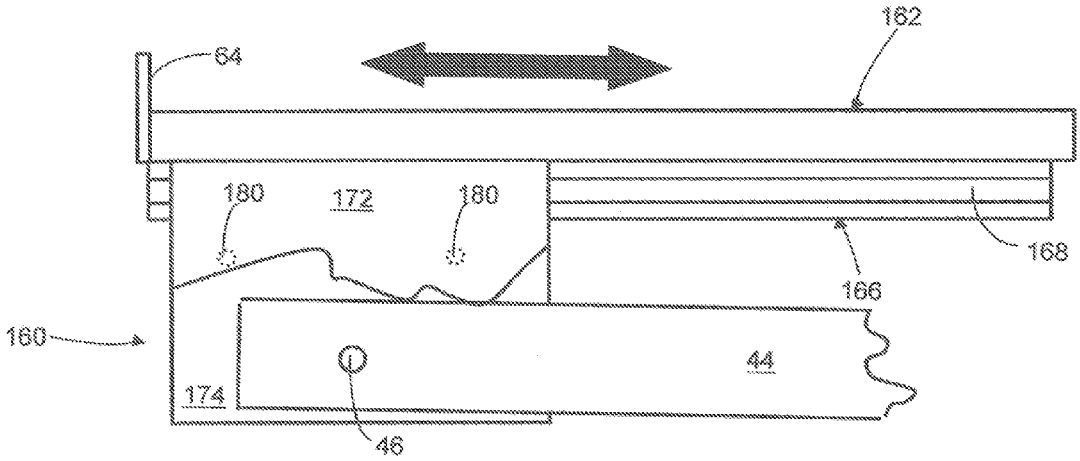
FIG. 11 is a side elevation view as in FIG. 10 showing the forward-rearward adjustability of the platform of the embodiment shown in FIG. 5.

Referring now to FIGS. 10 and 11, the upper section 44 of the arcuate member 40 includes a horizontally oriented hole 46. A pivot pin or bolt is passed through the openings 182, 184 in side members 172, 174 through opening 46 on stanchion 40. The bolt or pin may be fixed in one of the side members 172, 174 and a threaded portion may extend beyond the external surface of the opposite side member and a handle, seen best in FIG. 5, such as a T-shaped knob 190 may be used to clamp the two side members 172, 174 toward one another temporarily fixing the position of the side members 172, 174 to a tilt angle that is convenient for the user, as shown in FIG. 10. The plate 162 in addition to being pivotal is horizontally translatable by movement of the plate 162 and its fixed dovetail member 166 relative to the translationally fixed side members 172, 174 so as to move the platform plate 162 closer to, or farther from, the user as seen by comparing FIGS. 10 and 11.

From the above description it will be apparent that the platform assembly 160, on which the laptop computer rests, may be moved relative to the user both pivotally as well as translationally thus accommodating users of different height, girth, and personal preference for the position of the laptop computer during keyboarding as well as for maintaining the display at an appropriate height and angle for viewing.

Figure 13:
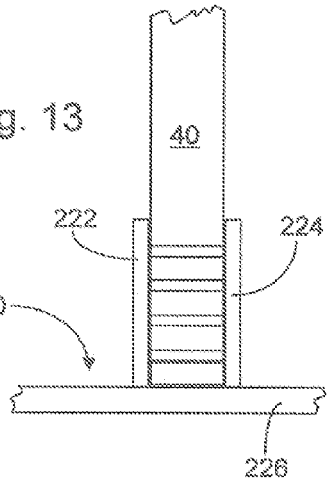
FIG. 13 is a partial front elevation view of the embodiment shown in FIG. 12.
Figure 12:
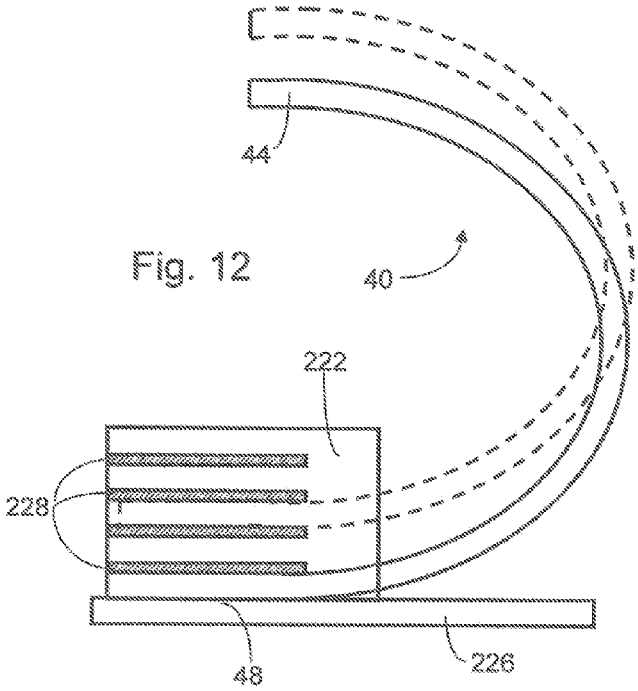
FIG. 12 is a side elevation view of another embodiment of a laptop computer desk in accordance with the present invention.

FIGS. 12 and 13 show another embodiment of a base for a laptop computer desk in accordance with the present invention. In this embodiment, the base 220 comprises two vertical flat panels or walls 222, 224 fixedly mounted on the flat baseboard 226. The two vertical panels are spaced apart approximately the distance equal to the width of the upwardly rising member 40. At least two horizontal shelves or members 228 (shown in section in FIG. 12) are vertically spaced at various heights from the base board 226. The vertical spacing of the horizontal members 228 is approximately equal to the height of the horizontal lower section of curved pylon 40. As seen in the break-away view of FIG. 12 of the base 220, the lower section 48 of curved member 40 slides in between and is temporarily fixed within the vertical panels 222, 224 and the horizontal shelves 228 so as to stand vertical relative to the base 220. By selectively placing the lower section of curved pylon 40, as shown in phantom lines, between two of the horizontal members 228, the height of the upper section 44 of pylon 40 may be raised so as to provide a convenient position for platform assembly 60 on which rests the laptop computer during use.

Figure 15:
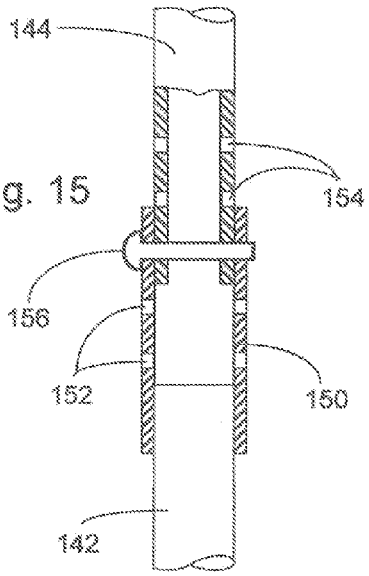
FIG. 15 is an enlarged sectional view of a portion of FIG. 14.
Figure 14:
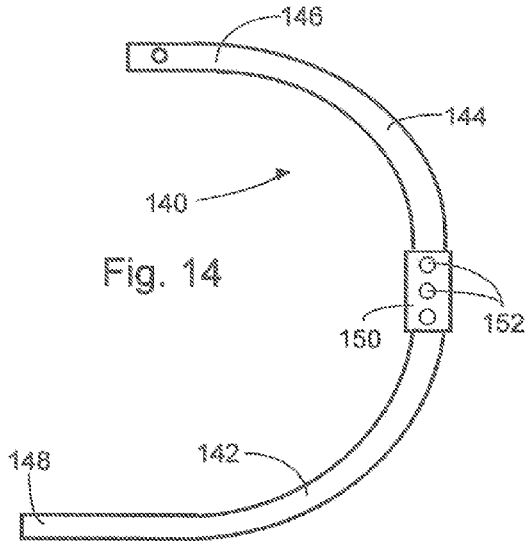
FIG. 14 is another embodiment of a laptop computer desk in accordance with the present invention.

In FIGS. 14 and 15 there is shown another embodiment of the laptop computer desk in accordance with this invention. In this embodiment, the platform supporting member 140 is constructed of two sections, a lower section 142 and an upper section 144. The upper section 144 has an upper end 146 that is substantially horizontal and cantilevered. Similarly, the lower section 142 has a lower end 148 that is substantially horizontal. The curvature of the upper and lower sections 142, 144 may be a quadrant of a circle or a shape similar to the corresponding section in other embodiments of the invention. The two sections 142, 144 of the platform supporting member are interconnected by means of a sleeve 150 having a plurality of vertically-spaced holes 152. The sleeve 150 may be fixed to the lower section 142. The upper section 144 has a plurality of openings 154 that may be registered with openings 152 in the sleeve 150. By aligning one set of the openings 154 in the upper section 144 with a pair of the holes in the sleeve 150 a pin 156 may be inserted through the holes and thus fix the upper section 144 relative to the lower section 142. The upper section 144 when the pin 156 is removed may be vertically adjusted by aligning other pairs of holes 154 with holes 152 in sleeve 150. It will therefore be seen that the height of the upper free end 146 of the curved member 140 which supports the platform is vertically adjustable. Thus, the height of the table that supports the laptop computer may be adjusted to the height of the user determined by the user's size or the height of the seat on which the user is sitting so as to attain a comfortable height for both keyboarding and viewing the screen of the laptop computer.

A variation of the configuration of the vertically rising member 140 is shown in FIG. 14A where the member 140*a* may have an upper section 144*a* substantially similar to the upper section shown in FIG. 14. However, the upper section is supported by a vertical lower section 142*a* that may be mounted directly on a base 122*a* at the edge of the base furthest from the user. The free end 146*a* is cantilevered over the base so the vertically rising member 140*a* leaves freedom for the user's positioning of his or her legs. As in the FIG. 14 embodiment, the upper section 144*a* is vertically adjustable. Those having ordinary skill in the art will appreciate that there are various ways in which mechanical height adjustment of the table 162 may be accomplished.

Still another embodiment of the laptop desk or apparatus for supporting a laptop computer at a height convenient for use by a seated user is shown in FIGS. 16-18. In this embodiment, a base 320 may comprise a flat plate 322 having a centrally located opening shown at 324 in FIG. 18. In this embodiment, at least the base 320 and the curved support member 340 are preferably fabricated from steel or rigid plastic or composites. As seen in the sectional view of member 340 in FIG. 17, the cross section at roughly the midpoint of the height of the member 340 is oval. At the upper end 344 of the stanchion 340 the cross-section may be circular. At the lower end of the support 340 the metal may be deformed to a flattened shape as shown at 346. The flattened portion 346 is fixedly attached to a ring, plate, or flat member (of any shape) 348 by welding or the like or could be integral with the stanchion 340. Ring 348 has a central opening 350. When assembled, the opening 324 in base 320 and the opening 350 in the lower end of stanchion 340 are aligned and an axle, shaft, pivot, rod, or similar cylindrical member 352 is inserted through openings 324 and 350. The rod 352 may have cap 354 at its upper end and 356 at its lower end thereby fixedly mounting the lower end of the stanchion 340 to the base plate 322 for rotational or pivotal movement as shown in phantom lines in FIG. 17. By virtue of the pivoting action between the curved support stanchion 340 and the table on which the computer rests, the stanchion 340 may be rotated to an out-of-way position thereby making it easier for the user to rise from the chair that is adjacent the laptop computer desk. This may be particularly convenient where the seat is immovable or relatively immovable. Furthermore, when combined with the translatable movement of the platform 60, as shown in FIG. 11, the computer platform may be pushed away from the user and then the stanchion may be rotated allowing easier egress from the fixed or relatively fixed seat on which the user was sitting during use of the laptop computer.

FIG. 18A shows a variation of the mounting device shown in FIG. 18. The member 348*a* to which the stanchion 340*a* is attached has a hole 350*a* which is laterally offset from the pivotal axis of shaft 352. The offset axis permits member 340*a* and the platform assembly 60 to be rotated to an out-of-the-way position so that the user may more easily arise from a chair after completing use of the desk.

Still another embodiment is shown in FIGS. 19-21. In this embodiment, the base 420 includes a base member 422 that has a shape comprising two cutout or arcuate sections 424, 426 near the front portion (nearest the user) of the laptop computer desk 410 and a rearward edge defined by a large arc 428. The arcuate cut-outs permit a typical office chair with a multi-leg truck having wheels or sliders at the end of each leg to be drawn up close to the laptop computer without contact between the wheels and the base member. The shape also will allow the forward portion of the base to be positioned between legs of a chair without rollers such as an armchair or kitchen chair. Those persons of ordinary skill in the art will recognize that other shapes may perform the same function, such as a triangle, trapezoid, cruciform or equivalents. The base 420 includes a housing mount 430, having a U-shaped cross section defining an opening or channel for receiving the foot or lower end section of stanchion 440.

The stanchion 440 as shown best in FIG. 21, rather than an arc or curve as in the other embodiments, is formed of a series of short straight sections, such as at 442, so as to define a portion of a polygon. The stanchion 440 as in the other embodiments extends away from the user thereby providing room for the user's legs without any interference.

A laptop computer support assembly 460 carries a flat plate, board, or computer rest 462 including at the horizontal edge nearest the user, a stop, fence, or lip 464 attached to the near edge of the rest 462 so as to prevent the laptop computer from sliding off of the rest when it is tilted as will be described. The laptop computer support assembly 460 includes a hollow longitudinally-extending box or housing shown generally at 466 into which the upper end section or head of stanchion 440 is inserted. The support assembly 460 may be horizontally moved back and forth relative to the user and may be fixed in position by means of a tightener 468. A horizontal member 470 is attached to the front of box 466; member 470 is hinged to the computer rest 462. A hinged prop 472 is mounted on the top of box 466 to support the rest 462 at a desired slanted position. It will therefore be appreciated that the support assembly 460 and the computer rest 462 is translatable horizontally toward and away from the computer user to suit the user's accustomed position for keyboarding and is also tiltable to conveniently position the keyboard and the screen of the laptop computer for the user.

Turning now to FIGS. 22-24, a modified or alternative embodiment of laptop computer support assembly 460 is shown. The housing 466 has a rectangular cross section including an opening for receiving the rectangular cross-section of the upper section 444 of stanchion 440. Alternatively, if stanchion 440 is made of metal or plastic, for example a pipe with circular cross section, housing 466 may be a tube with a slightly larger diameter than the pipe and capable of receiving the pipe for slidable adjustment. By comparing FIGS. 22A and 22B, translation motion of the subassembly 460 illustrates the positions of the rest 462 closer to, or farther from, the user. The tilt mechanism is shown in greater detail and will be seen to comprise a pivotally-mounted prop 472 that is hinged at 474 on the top of housing 466. As seen by comparing FIGS. 22A and 22B, the tilt of the rest 462 as shown in FIG. 22A may be increased as shown in FIG. 22B. The horizontal movement of the support assembly is fixed on the free end or section 444 of the stanchion 440 by the clamp 476 that is threadably engaged in the lower horizontal member of the box 466 so as to bear against the bottom surface of stanchion section 444 thereby locking the rest 462 and the laptop computer that is supported thereby in a desired position.

Laptop computers typically are provided with an internal or integral mouse, joystick, or other cursor-moving mechanism. However, many users still prefer an ordinary wired or wireless mouse. Therefore it may be desirable to provide a mouse platform on the laptop computer desk. The platform shown in FIGS. 25-29 is substantially the same as the platform shown in FIGS. 8-11. Where the parts are identical, the same reference numerals have been used. FIG. 25 is a bottom view of the platform 160 including a flat rectangular plate 162 generally the same size as a typical laptop computer. The plate 162 is attached to the sliding dovetail arrangement described in greater detail with respect to FIGS. 8-11. Attached to the right-hand edge of rest member 162 (as viewed from above) there is a mouse platform 560 that is mounted by a pair of hinges 562. The hinges may be self-locking hinges in the full open position permitting some pressure to be applied to the mouse platform. A latch member 564 is shown attached to the bottom of rest member 162 so that when the mouse platform is not in use, it can be swung into a position below the plate 162 and is engaged by the latch 564 to hold it in such position as shown best in FIG. 29. Alternatively, the size of the platform member 162 may be increased so as to provide adequate space on the platform itself for movement of an ordinary mouse. Moreover, there are many mechanisms available for temporarily securing the mouse platform 560 to the platform 162 if it is desired to decrease the size of the platform to the approximate size of the laptop and thereby put the mouse platform in an out-of-the-way position when not in use. The platform could be attached by clamps, pins, or dowels, a sliding dovetail if the member 162 and mouse platform 560 are made of wood, a slot in the member 162 into which the platform 560, of thinner dimension, could be moved into and out of the slot, as well as a variety of other ways that will be apparent to those persons having ordinary skill in the art.

In some instances, it may be desirable to provide the equivalent of a paper holder that is typically used by a desktop computer user where a hard copy document is being used to prepare an electronic document or to enter data on the computer. Such devices are well known in the art and used in particular by clerks or typists who need convenient viewing of a document for reference purposes when performing some computer task. To accommodate such desire, the laptop computer desk may be provided with a paper holder that may be selectively deployed by the laptop computer user. As seen in FIG. 25, a housing may be secured to the bottom surface of plate 162 as shown at 570. Within the housing 570 there is provided a rectangular cross-section arm 572 that is slidable from a first out-of-the-way position as shown in FIG. 25 to a second operative position as shown in FIGS. 27 and 29. As seen in FIGS. 27 and 29, the upper surface of arm 572 includes a hole into which a rod 574 may be placed together with a block 576 mounted on the free end of rod 574. Block 576 will permit a clamp to secure the top edge of a piece of paper to the block so that it hangs in a position convenient for viewing of the laptop computer user. Alternatively, instead of block 576, a clamp may be mounted on the top of rod 574 for holding the paper in a generally vertical position.

It may be desirable when using a laptop computer with the present invention to connect the computer to a source of AC power through the usual in-line transformer and/or connect it to a printer. To accommodate the cords to the printer and/or power it may be desirable to hold the cords in a convenient position. For example, a channel or trough could be formed in one surface of a solid stanchion or if the stanchion is hollow, such as a pipe, suitable holes could be provided through which the ends of the cord could enter and exit near the platform and the floor or base. Alternatively, a simple clamp or Velcro belt could be used to hold the cords in place.

Some of the claims concluding this specification are in a means-plus-function format and it is therefore incumbent upon applicant to clearly link the various embodiments of components and assemblies that comprise the laptop computer desk of the present invention to the functional means statements. Accordingly, the term "means for providing a stable base that rests on a floor" and supports other assemblies of the invention is exemplified by the base 20 shown in FIG. 3, the base 120 shown in FIG. 6, the base 220 shown in FIGS. 12 and 13, the base 122*a* shown in FIG. 14A, the base 320 shown in FIGS. 16-18A, and the base 420 shown in FIGS. 19-21 including the written descriptions of the embodiments in such figures and all equivalents thereof, which are intended to come within the scope of this means. The term "means on which a laptop computer or similar device rests," is exemplified by the fixed platform 60 shown in FIGS. 1-3, the movable platform shown in FIGS. 5-11, and the platform 460 shown in FIGS. 19-22B as well as FIGS. 25-28 including the written descriptions of the embodiments in such figures and all equivalents thereof which are intended to come within the scope of this means. The term "curved means for supporting said computer or device rest above a floor and shaped so as to avoid being positioned below the rest so as not to interfere with movement of the user's legs" is exemplified by the member 40 in FIGS. 1-3, the member 140 shown in FIGS. 5-7, the member 40 shown in FIG. 12, and the member 140 shown in FIGS. 14-15, the member 140*a* shown in FIG. 14A, and the member 340 and 340*a* shown in FIGS. 16-18A, as well as the member 440 shown in FIGS. 19-21 including the written descriptions of the embodiments in such figures and all equivalents thereof, which are intended to come within the scope of this means.

The term "means for retaining the computer or device on the rest" is exemplified by the lip 64 shown in FIGS. 1-3 and the rubber or high frictional contact pads shown in FIGS. 6-7 including the written description of the embodiments in such figures and all equivalents thereof which are intended to come within the scope of this means. The term "means for tiltably mounting the rest" is exemplified by the platform mounting assembly shown in FIGS. 5-11 and the platform assembly 460 shown in FIGS. 19, 21, 22A-22B, and 23 including the written descriptions of the embodiments in such figures and all equivalents thereof, which are intended to come within the scope of this means. The term "means for translationally adjusting the position of the rest" relative to the stanchion is exemplified by the assembly shown in FIGS. 5-11 and in FIGS. 19-24 including the written description of the embodiments in such figures thereof and all equivalents thereof, which are intended to come within the scope of this means. The term "means for vertically adjusting the height of the rest" relative to the base is exemplified by the embodiment shown in FIGS. 12-13 and in FIGS. 14, 14A, and 15 including the written descriptions of the embodiments of such figures and all equivalents thereof, which are intended to come within the scope of this means. The term "means for supporting a mouse" comprises the embodiment shown in FIGS. 25-29 including the description of such embodiment and all equivalents thereof, which are intended to come within the scope of this means. The term "means for supporting a hard copy for convenient reading by the user of the device" includes the assembly 570 shown in FIGS. 25-29 including the written description thereof and all equivalents thereof, which are intended to come within the scope of this means.

From the various embodiments shown, it will be obvious that many modifications and variations of the present invention are possible in light of the above teachings. It is, therefore, to be understood that the invention may be practiced otherwise than as specifically described in the various embodiments in this specification and that the scope of the invention is to be defined by the appended claims.

The invention claimed is:

1. A laptop computer desk comprising:

a horizontal floor base comprising a flat plate on which a user's feet may be placed;

a single smooth curve vertically disposed one-piece platform support member having an integral straight, horizontally disposed section at its upper end and at its lower end section, said upper end section positioned above and approximately centered over said lower end;

a platform having a length and width approximately equal to the length and width of a laptop computer;

a housing slidably attached to the bottom of said platform to permit translation of said platform toward and away from the user, said housing pivotally mounted to said upper end section of said platform support member; and a mounting unit affixed to said base and operatively coupled to said platform support member straight horizontally disposed section lower end.

2. The laptop computer desk of claim 1 wherein said curved platform support member has a C-shape.

3. The laptop computer desk of claim 1 wherein said curved platform support member has a substantially semi-circular shape.

4. The laptop computer desk of claim 1 wherein said curved platform support member has a substantially parabolic shape.

5. The laptop computer desk of claim 1 wherein said curved platform support member has a substantially semi-elliptical shape.

6. The laptop computer desk of claim 1 additionally including a computer mouse platform mounted on said laptop computer platform, and movable from a stored location to an operative location.

7. The laptop computer desk of claim 1 additionally including a paper holder supported by said platform.

8. The laptop computer desk of claim 1 wherein the base is made of a material from the group comprising metal, plastic, composites and wood or combinations thereof.

9. The laptop computer desk of claim 1 wherein the platform support member is made of a material from the group comprising metal, plastic, composites and wood or combinations thereof.

10. The laptop computer desk of claim 1 wherein the platform is made of a material from the group comprising metal, plastic, composites and wood or combinations thereof.

11. The laptop computer desk of claim 1 wherein the base is generally rectangular with two cut-out portions in the area nearest the user to accommodate the feet of a user's chair.

12. A laptop computer desk adapted for use by a seated user comprising:

a base resting on the floor;

a platform for supporting the laptop computer;

a single, vertically oriented, one-piece substantially C-shaped platform support member having integral upper and lower ends each having a substantially horizontal section;

a mounting unit affixed to the base and operatively coupled to the lower end of said platform support member; and a housing pivotally attached to one edge of said platform nearest the user for slidably receiving the upper end of the platform support member to permit said platform to be repositionable toward and away from the user and at various angles with respect to the horizontal.

13. The apparatus of claim 12 wherein the curvature of the support member is in a vertical plane orthogonal to the user and is concave toward the user.

14. The apparatus of claim 12 wherein the mounting unit is pivotally mounted on the base.

15. The apparatus of claim 14 wherein the pivotal axis is laterally offset from a central vertical plane.

16. The apparatus of claim 2 wherein said platform includes a frictional surface to mitigate inadvertent movement of said laptop computer.

17. The apparatus of claim 2 wherein said housing includes a sliding male dovetail member mounted on the lower surface of said platform and a pair of connecting side members pivotally mounted on the free end of said curved support member and having female dovetail slots for slidably mating with said male dovetail member.

18. The apparatus of claim 17 wherein the height of said platform is vertically adjustable.

19. The apparatus of claim 17 wherein the base is shaped so that it does not prevent a rollable desk chair with multiple feet from substantially interfering with the motion of the feet as the chair is drawn toward the computer rest member.

20. A floor stand for supporting a laptop computer at a height comprising:

a pedestal on which a user may place his or her feet;

a single upright having a horizontally disposed straight bottom section mounted on the pedestal, a horizontally disposed straight upper section, and an intermediate section comprising a smooth C-shaped curve with no straight portions; and a computer rest adjustably mounted on the straight upper section of the upright, said upright shaped so that the only sections of the upright positioned below the computer rest are the upper and lower straight sections.

* * * * *